United States Patent [19]

Marchesani

[11] 4,002,264

[45] Jan. 11, 1977

[54] DISPENSING MEANS FOR MOIST TISSUES

[75] Inventor: Cesare N. Marchesani, Union City, N.J.

[73] Assignee: Colgate-Palmolive Company, New York, N.Y.

[22] Filed: Jan. 30, 1975

[21] Appl. No.: 545,368

[52] U.S. Cl. ..... 221/63; 221/135; 206/205; 206/409

[51] Int. Cl.[2] ..... B65H 49/02

[58] Field of Search ..... 221/63, 45, 33, 64, 221/135; 222/541, 80, 81; 206/409, 205, 389; 150/3; 242/55-53

[56] References Cited

UNITED STATES PATENTS

| | | | |
|---|---|---|---|
| 3,282,477 | 11/1966 | Heuchert | 222/541 |
| 3,393,796 | 7/1968 | Clarke | 206/205 |
| 3,473,589 | 10/1969 | Gotz | 150/3 |
| 3,523,653 | 8/1970 | Hansen | 242/55.53 |
| 3,784,055 | 1/1974 | Anderson | 221/63 X |
| 3,862,703 | 1/1975 | Dutcher | 221/63 |

*Primary Examiner*—Robert B. Reeves
*Assistant Examiner*—Joseph J. Rolla
*Attorney, Agent, or Firm*—Kenneth A. Koch; Herbert S. Sylvester; M. M. Grill

[57] ABSTRACT

A flexible bag dispenser containing a roll of interconnected moist tissues is disclosed. The tissues are withdrawn from the center of the roll and pass through a restricted opening in the bag. A reclosable closure means is provided at the dispensing end of the bag to prevent evaporative losses and to protect the tissues when not in use.

6 Claims, 6 Drawing Figures

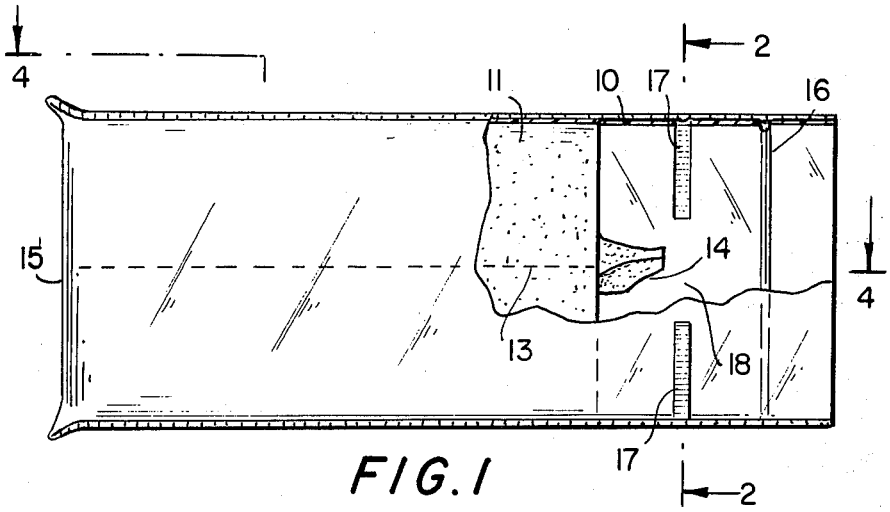
FIG. 1
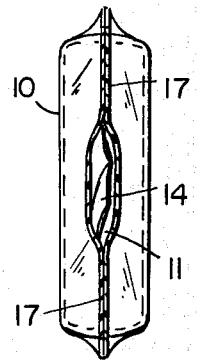
FIG. 2
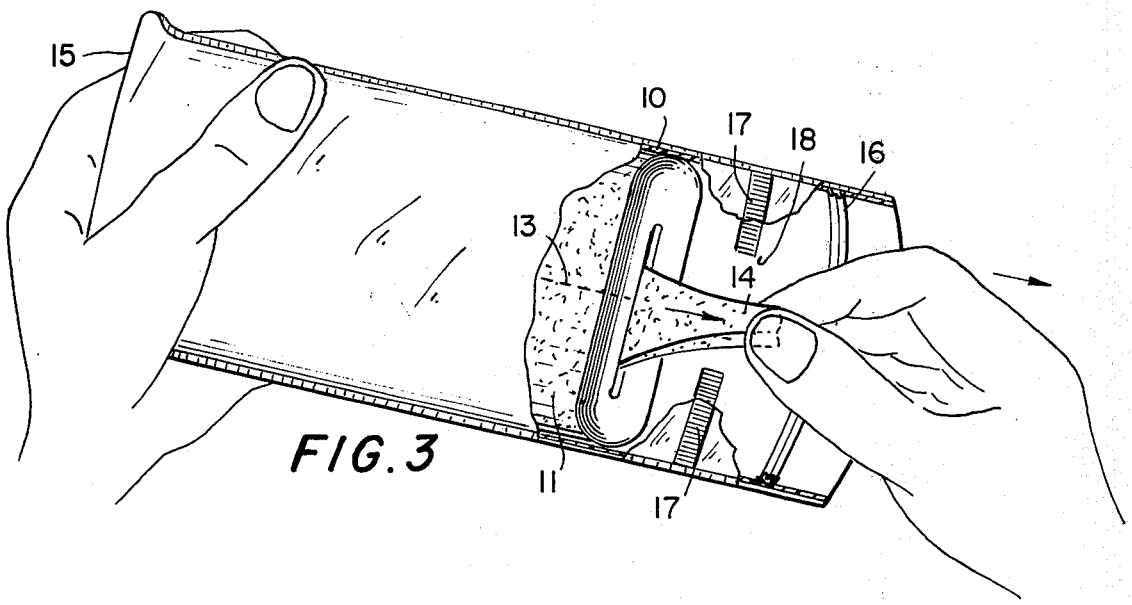
FIG. 3
FIG. 4
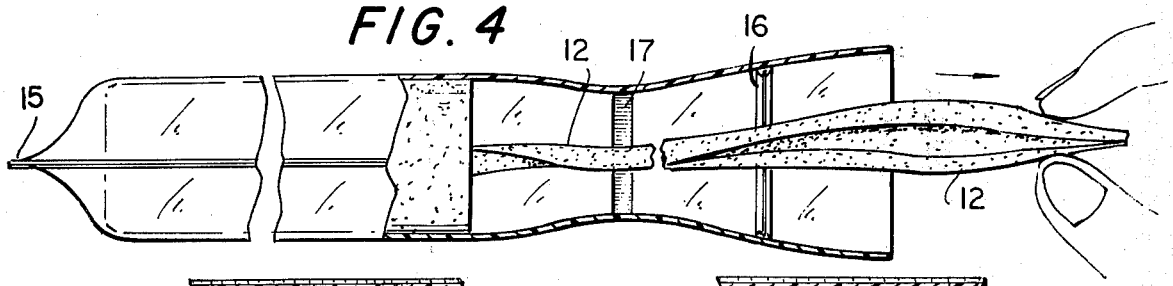
FIG. 5
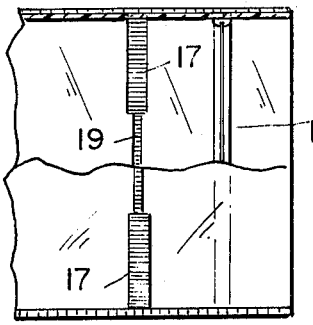
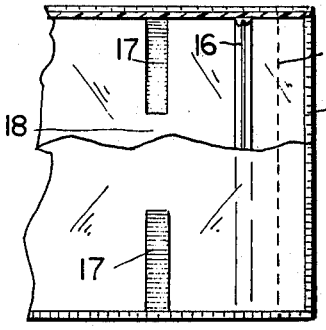
FIG. 6

DISPENSING MEANS FOR MOIST TISSUES

BACKGROUND OF THE INVENTION

The invention pertains to the dispensing of moist tissues of the type commonly used to clean various parts of the body such as the hands and face. Tissues of this type are typically high wet strength paper or non-woven fabrics impregnated with a liquid having solvent properties.

Moist tissues are currently available to consumers in various forms of packaging; the most common of which are the individually folded tissues contained in a sealed metal foil enclosure. Moist tissues are also available in the form of a stack of interconnected or separate sheets and rolls containing a continuous strip of moistened sheets separated by lines of weakness. The rolled product is either dispensed from the center of the roll through a restricted orifice or from the outside of the roll through an elongated slot.

The dispensing of moist tissues from a stack of sheets is taught in U.S. Pat. Nos. 3,499,575; 3,780,908 and 3,819,043 among others.

The dispensing of moist tissues from a roll is taught in the following U.S. Patents, among others: Harrison U.S. Pat. No. 3,749,296; Cordis U.S. Pat. No. 3,368,522; Walker U.S. Pat. No. 3,775,801 and Hoffmann U.S. Pat. No. 3,592,161. The Cordis, Walker and Hoffmann Patents teach the dispensing of moist tissue from the outside of a continuous roll that is supported in a rigid cylindrical container. A reservoir of the impregnating liquid is located in the bottom of the container to prevent the tissues from drying out and the tissues are withdrawn for use through an elongated slot disposed in the wall of the container. The Harrison Patent is concerned with dispensing moist tissues from the inside of a coreless roll through a narrow slit disposed in the top of a generally cylindrical container.

SUMMARY OF THE INVENTION

The invention provides a package of moist tissues that is inexpensive, handy and easy to use. The package includes a flexible walled bag and a plurality of premoistened tissues disposed in the bag. The bag has a closed end and an openable end. The openable end has a reclosable closure means disposed in its upper portion and a restricting means disposed between the reclosable means and the tissues. The restricting means provides an opening, smaller than the cross section of the bag, through which the tissues are dispensed.

Preferably the tissues are a continuous length of premoistened interconnected sheets of paper or non-woven fabric separated by lines of weakness in the form of a coreless roll. A free end of the tissues, extending from the center of the roll, is provided for the user to grasp. To use the product, the closure means is opened and the free end of the roll is grasped through the opening formed by the restricting means. A sheet of tissue is withdrawn from the package and "snapped-off" from the roll. Preferably the spacing between the closure means and restricting means is large enough to result in an adequate free length of tissue above the opening for easy grasping by the consumer for withdrawing the next sheet of tissue. After use, the closure means is reclosed to minimize evaporative loss of the impregnating liquid and to protect the tissues.

BRIEF DESCRIPTION OF THE DRAWING

The invention will be described in further detail with reference to the accompanying drawing in which:

FIG. 1 is a partial cut away plan view of a package of moist tissues according to the invention, FIG. 2 is a cross-sectional view of the package of FIG. 1 taken along line 2 — 2 of FIG. 1, FIG. 3 is a partial cut-away view of the package of FIG. 1 during use, FIG. 4 is a partial cross-sectional view of the package of FIG. 1 during use, taken along line 4 — 4 of FIG. 1, FIG. 5 is a partial cut-away view of a portion of a package according to the invention and, FIG. 6 is a partial cut away view of an alternate embodiment of a portion of a package according to the invention.

DESCRIPTION OF PREFERRED EMBODIMENT

Referring to the drawing, a flexible wall bag 10 containing a roll of interconnected sheets of premoistened tissues 11 is provided. The bag 10 is preferably a plastic material such as polyethylene and is chosen to be impervious to gaseous and liquid materials and strong enough to withstand consumer handling. The bag 10 can be transparent or opaque and can be made from a suitable metallic foil material such as aluminum. Preferably the roll 11 and bag 10 are flattened, i.e., have an oval rather than a round cross section as shown most clearly in FIG. 3 of the drawing.

The roll of tissues 11, includes a plurality of interconnected sheets 12, separated by lines of weakness 13. The sheets 12 are in the form of a coreless roll having a free end 14 extending from the inside of the roll. The sheets can be a non-woven fibrous material such as a toweling paper stock having a wet tensile strength of at least about 1 lb./inch. or a non-woven fabric. The sheets are impregnated, preferably to saturation, with an impregnating liquid having solvent properties that may contain medically effective substances such as alcohols, for example, ethanol, glycerine, sorbite, antibacterial substances such as hexachlorophene, and perfumes. The impregnating liquid may be applied to the sheets of tissue in the form of an aqueous solution or emulsion.

The bag 10 includes a closed end 15, and a dispensing end. The dispensing end includes a reclosable closure means 16 and a restricting means 17 disposed between the roll of tissues 11 and the closure means 16. The restricting means 17 includes a seal extending across a major portion, typically 50 to 80 percent, of the bag width. The seal is preferably composed of two equal portions, each extending from the edge of the bag toward the center. The central area of the restricting means can be unsealed and provides an opening 18 through which the free end 14 is withdrawn. According to the invention, the opening 18 provides "drag" to the tissue as it is withdrawn, permitting it to be "snapped-off" by the user as a line of weakness 13 passes through the opening. The seals forming the restricting means are preferably heat seals but can be any other suitable means for joining the wall of the bag 10 together, such as adhesive.

According to the invention and as shown in FIG. 5, the opening 18 of the restricting means can be initially lightly sealed by sealing means 19 to protect the product until first use. The light seal 19 can be a heat seal or an adhesive seal and should be capable of easy penetration by finger pressure when the product is first used as opposed to the relatively permanent seals forming restricting means 17.

Alternately, or in addition to sealing means 19, the end of the bag 10 adjacent the closure means 16 can be permanently closed by sealing means 20 to protect the product prior to first use. The sealing means 20 can be a heat seal, adhesive bond or other appropriate sealing means. As shown in FIG. 6 the sealing means 20 is separated from the closure means 16 by frangible means 21 that extends around the entire periphery of bag 10. The section of the bag containing the sealing means 20 can be easily removed to gain access to the tissues by tearing along the frangible line 21 and removing the sealed end 20.

According to the invention, the reclosable portion 16 can comprise mating male and female members disposed continuously along corresponding opposite inner surfaces of the bag. A suitable reclosable means of this type is disclosed in U.S. Pat. No. 3,198,228. Any reclosable means that can be opened and easily reclosed including adhesives, such as double faced adhesive tapes may be used.

To use the new product, the sealing means 20, if present, is first removed by tearing along frangible line 21. The closure means 16 is opened and the finger is inserted through the central region 18 of the restricting means 17 to break the light seal 19 and provide access to the free end 14. To ease access to the interior of the package, the sides of the package can be grasped between the thumb and forefinger and squeezed to further open the flattened openings. The free end 14 is grasped between two fingers and a tissue is withdrawn from the center of the roll in roped form (FIG. 3). The free end 14 is withdrawn until the next line of weakness 13 passes through the opening 18, at which point the free end 14 can be snapped to separate the withdrawn sheet from the roll (FIG. 4). After use the reclosable closure means 16 is reclosed to protect the tissues and prevent evaporation of the impregnating liquid.

The new product has been described in terms of preferred embodiments and various modifications may be made within the scope of the invention, which is defined by the following claims.

I claim:

1. A package of moist tissues comprising:

a. a flexible bag having a closed end and a dispensing end, b. a plurality of separably interconnected liquid impregnated tissues in the form of a flattened coreless roll having an oval cross section, c. said bag being elongated and closely conforming to the shape of said roll, d. a reclosable closure disposed at said dispensing end and, e. restricting means for facilitating separation of said tissues disposed between said reclosable closure and said tissues, f. said restricting means including two sealed strips extending inwardly from opposed outer edges of said bag to define a centrally located opening for the passage of said tissues from inside of said roll, g. said tissues being separably interconnected by lines of weakness therebetween, h. the size of said opening being chosen to provide sufficient drag to said tissues to permit separation of said tissues at said lines of weakness during withdrawal from said package.

2. The package of claim 1 wherein said tissues are of a non-woven fibrous material.

3. The package of claim 1 wherein said liquid has solvent properties.

4. The package of claim 1 wherein said reclosable closure includes a mating groove and projection internally disposed on opposite side of said bag.

5. The package of claim 1 wherein said centrally located opening includes a sealing member that is easily penetrated by finger pressure.

6. The package of claim 1 wherein said dispensing end includes a sealing member disposed outwardly from said reclosable closure and a frangible member disposed between said reclosable closure and said sealing member.

* * * * *